US010101081B2

(12) United States Patent
Viegas et al.

(10) Patent No.: US 10,101,081 B2
(45) Date of Patent: Oct. 16, 2018

(54) METHOD OF OPERATING A CRYOGENIC TEMPERATURE CONTROL APPARATUS

(75) Inventors: Herman H. Viegas, Bloomington, MN (US); David J. Vander Woude, Farmington, MN (US); Suresh Kumar, Shakopee, MN (US); Joseph L. Glentz, Winona, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 3748 days.

(21) Appl. No.: 11/549,990

(22) Filed: Oct. 17, 2006

(65) Prior Publication Data

US 2007/0144191 A1 Jun. 28, 2007

Related U.S. Application Data

(60) Provisional application No. 60/727,482, filed on Oct. 17, 2005.

(51) Int. Cl.

| | |
|---|---|
| ***F25D 19/00*** | (2006.01) |
| ***F17C 7/04*** | (2006.01) |
| ***F25D 29/00*** | (2006.01) |
| ***F25J 3/04*** | (2006.01) |
| *F25D 3/10* | (2006.01) |
| *F25D 3/12* | (2006.01) |

(52) U.S. Cl.

CPC ..... *F25D 29/001* (2013.01); *F17C 7/04* (2013.01); *F25J 3/04478* (2013.01); *F17C 2221/013* (2013.01); *F17C 2221/014* (2013.01); *F17C 2223/0161* (2013.01); *F17C 2223/033* (2013.01); *F17C 2223/046* (2013.01); *F17C 2225/0123* (2013.01); *F17C 2225/033* (2013.01); *F17C 2227/0313* (2013.01); *F17C 2227/0393* (2013.01); *F17C 2250/0439* (2013.01); *F17C 2250/0473* (2013.01); *F17C 2250/0478* (2013.01); *F17C 2250/0673* (2013.01); *F17C 2265/012* (2013.01); *F17C 2270/0171* (2013.01); *F25B 2700/21172* (2013.01); *F25B 2700/21173* (2013.01); *F25D 3/105* (2013.01); *F25D 3/125* (2013.01); *F25D 2400/30* (2013.01)

(58) Field of Classification Search

CPC .. F25J 3/04472; F25J 3/04478; F25J 3/30449; F25J 3/04503; F25J 3/04812; F25J 3/04824; F25J 3/0483; F17C 2250/0473; F17C 2250/0673; F17C 9/02; F17C 9/904

USPC ..... 62/157, 201, 50.2, 185, 216

See application file for complete search history.

(56) References Cited

U.S. PATENT DOCUMENTS 3,058,317 A * 10/1962 Putman ..... 62/50.2
3,287,925 A * 11/1966 Kane et al. ..... 62/52.1
(Continued)

*Primary Examiner* — John F Pettitt
(74) *Attorney, Agent, or Firm* — Hamre, Schumann, Mueller & Larson, P.C.

(57) ABSTRACT

A method of temperature control in a cryogenic temperature control apparatus. The method includes operating the cryogenic temperature control apparatus in a first mode, and delivering a first flow rate of cryogen from a storage tank to an evaporator coil in the first mode. The cryogenic temperature control apparatus is operated in a second mode after operating the cryogenic temperature control apparatus in the first mode for a predetermined time duration. A second flow rate of cryogen that is lower than the first flow rate is delivered to the evaporator coil in the second mode.

20 Claims, 9 Drawing Sheets

(56) References Cited

U.S. PATENT DOCUMENTS

| | | | | | |
|---|---|---|---|---|---|
| 3,552,143 | A | * | 1/1971 | Johnson | 62/48.3 |
| 3,638,443 | A | * | 2/1972 | Maurer | 62/52.1 |
| 3,672,182 | A | * | 6/1972 | Stowasser et al. | 62/98 |
| 3,699,694 | A | * | 10/1972 | Hales et al. | 62/158 |
| 3,705,500 | A | * | 12/1972 | Jehle | 62/223 |
| 4,142,376 | A | * | 3/1979 | Sandberg | 62/158 |
| 5,018,084 | A | * | 5/1991 | Frank | 708/105 |
| 5,311,927 | A | | 5/1994 | Taylor et al. | |
| 5,660,046 | A | * | 8/1997 | de Langavant et al. | 62/50.3 |
| 6,345,509 | B1 | * | 2/2002 | Garlov et al. | 62/62 |
| 6,631,621 | B2 | * | 10/2003 | VanderWoude et al. | 62/201 |
| 7,325,441 | B2 | * | 2/2008 | Liu et al. | 73/40 |
| 2003/0029179 | A1 | * | 2/2003 | Vander Woude et al. | 62/201 |

* cited by examiner

METHOD OF OPERATING A CRYOGENIC TEMPERATURE CONTROL APPARATUS

CROSS-REFERENCE TO RELATED APPLICATIONS

This application claims priority to U.S. Provisional Application No. 60/727,482, filed Oct. 17, 2005. The entire contents of this prior application is hereby incorporated by reference herein.

BACKGROUND

The present invention relates generally to air conditioning and refrigeration systems, and more specifically to a method of operating a cryogenic temperature control apparatus.

Conventional cryogenic temperature control systems typically store a compressed cryogen such as carbon dioxide, liquid nitrogen, etc. in a pressurized storage tank. The cryogen is directed along a conduit from the storage tank to an evaporator coil that extends through a heat exchanger. Relatively warm air is passed across the evaporator coil and is cooled by the evaporator coil. The cooled air is returned to a cargo compartment to pull down the temperature of the cargo compartment to a predetermined set point temperature. The warm air heats and vaporizes the cryogen in the evaporator coil. After the heat transfer has occurred, the vaporized cryogen is typically exhausted to the atmosphere.

Control systems that are used to operate existing cryogenic temperature control apparatuses are generally relatively complex, and regulate the temperature of the cargo to be at a set point temperature. These control systems require substantial computing power and programming skill to properly implement and operate. Additionally, the complexity of the existing control systems generally limits the flexibility of these temperature control apparatuses. The complexity and inflexibility of these control systems to adjust to various conditions of the cargo compartment can result in shutdown of the control apparatuses due to a relatively high consumption of fuel (e.g., carbon dioxide). This is especially problematic when the cryogenic temperature control apparatus is mounted to a vehicle for transportation between geographical locations.

SUMMARY

In one embodiment, the invention provides a method of temperature control in a cryogenic temperature control apparatus. The method includes operating the cryogenic temperature control apparatus in a first mode, and delivering a first flow rate of cryogen from a storage tank to an evaporator coil in the first mode. The cryogenic temperature control apparatus is operated in a second mode after operating the cryogenic temperature control apparatus in the first mode for a predetermined time duration. A second flow rate of cryogen that is lower than the first flow rate is delivered to the evaporator coil in the second mode.

In another embodiment, the invention provides a cryogenic temperature control apparatus that includes an evaporator coil, a storage tank, a valve assembly, and a controller. The evaporator coil is in thermal communication with an air-conditioned space, and includes an air inlet and an outlet. The storage tank is in fluid communication with the evaporator coil. The valve assembly is positioned between the storage tank and the evaporator coil, and can be adjusted between a first position configured to deliver a first mass flow rate of cryogen and a second position configured to deliver a second mass flow rate of cryogen. The first position defines a first mode of operation for the cryogenic temperature control apparatus and the second position defines a second mode of operation for the cryogenic temperature control apparatus. The controller is in electrical communication with the valve assembly, and is programmed to selectively operate the valve assembly between the first and second positions, and to limit the time duration that the cryogenic temperature control apparatus is operated in the first mode.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
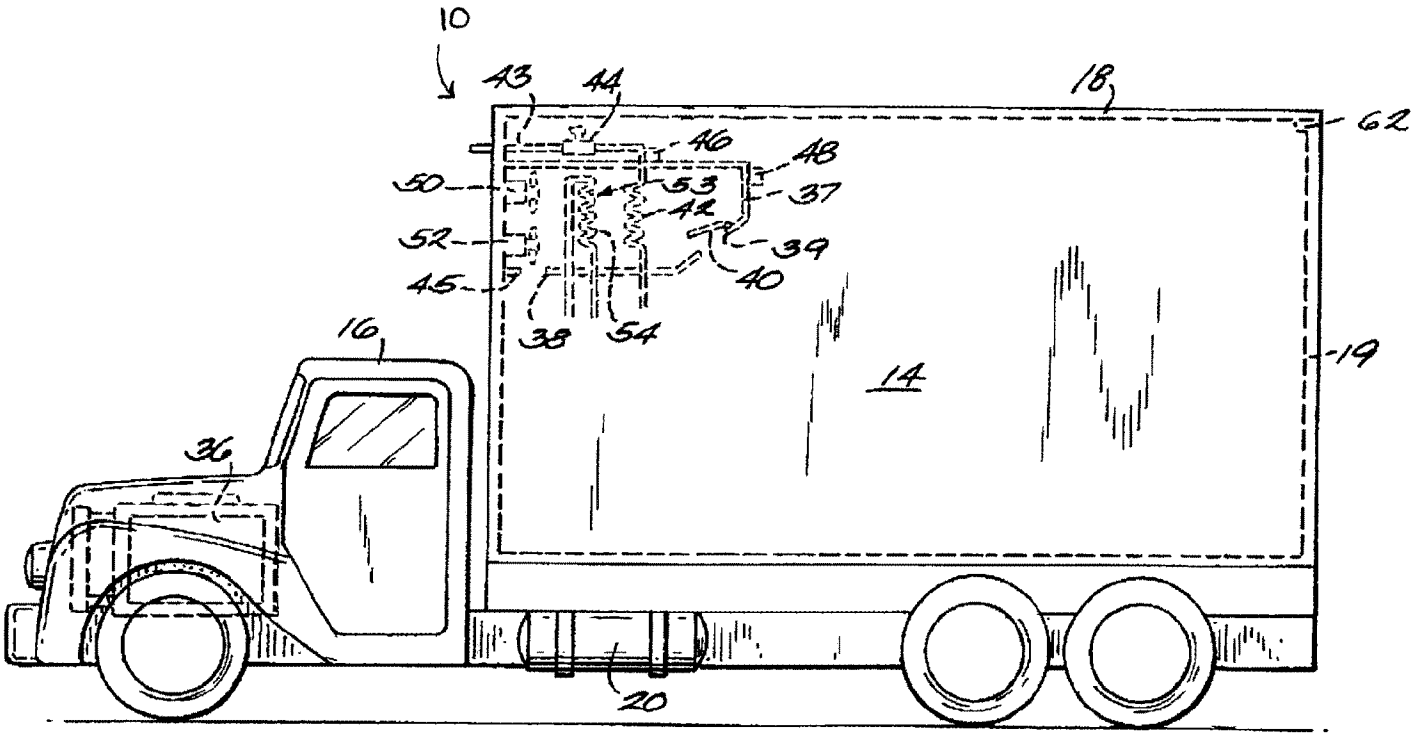
FIG. 1 is a side view of a vehicle including a cryogenic temperature control apparatus in accordance with the present invention.

FIG. 1 illustrates a cryogenic temperature control apparatus 10 employing the present invention. The control apparatus 10 is operable to control the temperature of an air-conditioned space 14. As shown in FIG. 1, the air-conditioned space 14 is the cargo compartment in a vehicle 16. In other applications, the control apparatus 10 can alternatively be used on other vehicles, such as a tractor-trailer combination, a container, and the like. Similarly, the control apparatus 10 can be used to control the temperature in the passenger space of a vehicle, such as for example, a bus or the passenger compartment of a truck. In other embodiments, the control apparatus 10 can be operable in stationary applications. For example, the temperature control apparatus 10 can be operable to control the temperature of buildings, areas of buildings, storage containers, refrigerated display cases, and the like.

The control apparatus 10 is described herein as being used to pull down and maintain the temperature in a single air-conditioned space 14. In other embodiments, the control apparatus 10 could also be used in applications that have multiple air-conditioned spaces 14.

As used herein and in the claims, the term "air-conditioned space 14" includes any space to be temperature and/or humidity controlled, including transport and stationary applications for the preservation of foods, beverages, and other perishables, maintenance of a proper atmosphere for the shipment of industrial products, space conditioning for human comfort, and the like. The control apparatus 10 is operable to control the temperature of the air-conditioned space 14 to a predetermined set point temperature ("SP").

As shown in FIG. 1, the air-conditioned space 14 is enclosed by an outer wall 18 that has one or more doors 19. The doors 19 open and close to allow access to the air-conditioned space 14 so that an operator can insert a product into and remove the product from the air-conditioned space 14.

The control apparatus 10 also includes a storage tank 20, which houses a cryogen under pressure. The cryogen is preferably carbon dioxide ($CO_2$). However, it will be readily understood by one of ordinary skill in the art that other cryogens, such as $LN_2$ and LNG can also or alternately be used.

Figure 2:
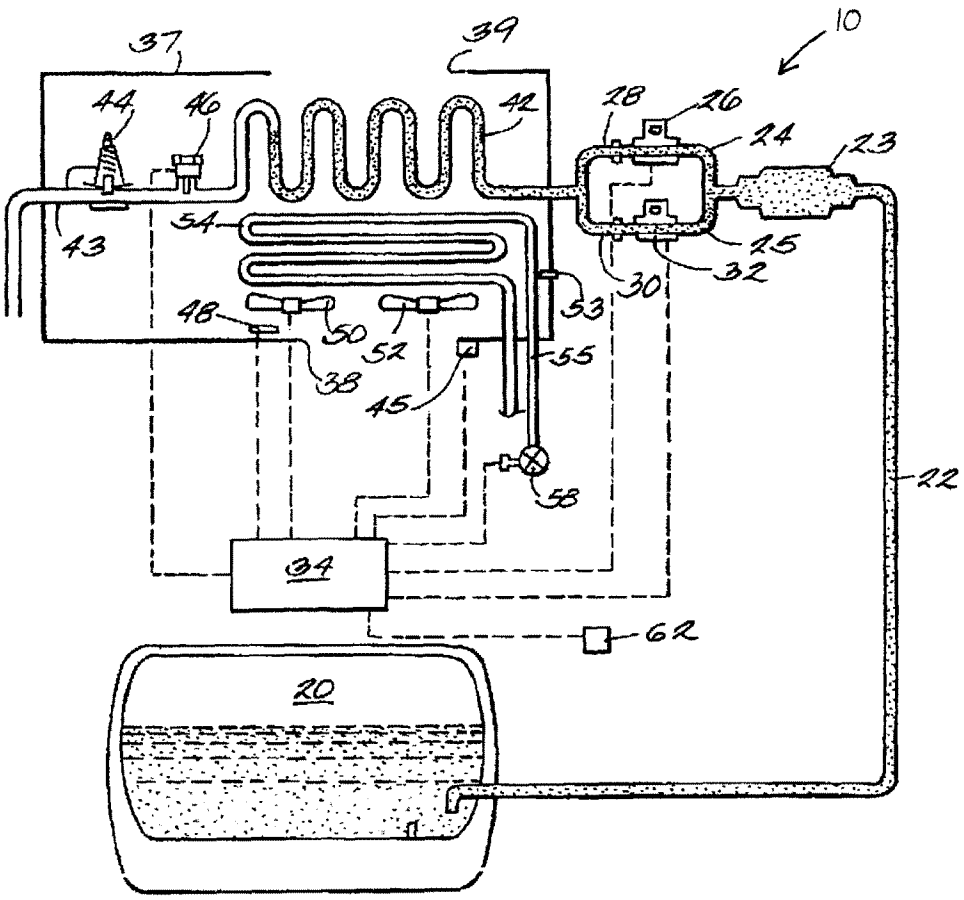
FIG. 2 is a schematic drawing of the cryogenic temperature control apparatus of FIG. 1.

FIG. 2 shows a conduit 22 that is connected to the underside of the storage tank 20, and that includes a filter 23, a first branch 24, and a second branch 25. The conduit 22, including the first branch 24, defines a first flow path 28. Similarly, the conduit 22, including the second branch 25, defines a second flow path 30. As shown in FIG. 1, the first and second branches 24, 25 are fluidly connected to the storage tank 20 and converge at a junction located downstream from the storage tank 20.

The first branch 24 includes a first control valve 26 that has a first relatively large orifice, and that controls the mass flow rate of cryogen through the first branch 24 during heating and cooling cycles. The second branch 25 also extends from a low point of the storage tank 20 and includes a second control valve 32. The control valve 32 includes a second smaller orifice and a porting that is smaller than the porting of the first valve 26, and controls the mass flow rate of cryogen through the second branch 25 during heating and cooling cycles. Preferably, the first and second control valves 26, 32 are operated by an electrically controlled solenoid (not shown), which move the first and second control valves 26, 32 between respective open positions and closed positions. Other embodiments may include other valve assemblies and actuators.

The first and second control valves 26, 32 as shown and described are two-position "on/off" valves. In other embodiments, the valves 26, 32 can be other types of valves (e.g., modulation, pulse, expansion, etc.). The arrangement of the first and second valves 26, 32 in the control apparatus 10 preferably provides four distinct mass flow rates. One having ordinary skill in the art will appreciate that in other applications additional valves can be used to provide additional flow rates. In general, the control apparatus 10 can provide a greater variety of available mass flow rates between the storage tank 20 and an evaporator coil 42.

The control apparatus 10 also includes a heat exchanger 37 positioned in the air-conditioned space 14. The heat exchanger 37 includes an air intake 38 that receives air from the air-conditioned space 14, and an air outlet 39 that exhausts the air from the heat exchanger 37. A damper 40 can be used to alter airflow through the heat exchanger 37. In other constructions, fans or blowers may be used to control airflow through the heat exchanger 37.

The first and second flow paths 28, 30 fluidly connect to an inlet of an evaporator coil 42 located in the heat exchanger 37. During cooling operations, cryogen from the storage tank 20 flows along the flow path 22 in a liquid or mostly liquid state into the evaporator coil 42. Air from the air-conditioned space 14 travels across the evaporator coil 42 and is cooled by the relatively cold evaporator coil 42. At the same time, the cryogen in the evaporator coil 42 is vaporized by contact with the relatively warm air. The cooled air is returned to the air-conditioned space 14 through the air outlet 39 to cool the air-conditioned space 14 and the vaporized cryogen flows out of the evaporator coil 42 through an outlet 43 and is exhausted to the atmosphere. A regulator 44 is positioned in fluid communication with the outlet 43 to regulate cryogen vapor pressure at about a desired pressure.

The control apparatus 10 further includes a first fan 50 and a second fan 52 positioned within the heat exchanger 37 to draw air from the air-conditioned space 14 through the heat exchanger 37, which includes a heating element 53. The heating element 53 is located in the heat exchanger 37 and includes a heating coil 54 and a fluid conduit 55, which extends between the heating coil 54 and a remotely located coolant cycle (not shown). A third valve 58 is positioned along the fluid conduit 55 for controlling the flow of coolant from the cooling cycle to the heating coil 54. During operation, the engine 36 heats the coolant in the coolant cycle. When heating is required, the third valve 58 is opened and coolant is directed through the heating element 53 to heat air in the heat exchanger 37.

The control apparatus 10 also includes a first sensor or return air sensor 45, a second sensor or evaporator coil outlet temperature sensor 46, a third sensor or defrost termination switch 48, a door sensor 62, and a controller 34. The return air sensor 45 is located between the evaporator coil 42 and the inlet 38 and records the return air temperature ("RA"), which is the temperature of the air returning to the heat exchanger 37 from the air-conditioned space 14. The return air sensor 45 is in electrical communication with the controller 34 to deliver a signal indicative of the return air temperature.

The outlet temperature sensor 46 is positioned adjacent the outlet 43 and records the temperature of cryogen vapor ("ECOT") exiting the evaporator coil 42. The outlet temperature sensor 46 is in electrical communication with the controller 34 to deliver a signal indicative of the outlet temperature. Similarly, the defrost termination switch 48 is positioned on the heat exchanger 37 to sense a predetermined defrost termination temperature ("DTS"). The defrost termination switch 48 is in electrical communication with the controller 34 to deliver a signal indicative of the defrost termination temperature DTS.

The door sensor 52 is in communication with the doors 19 to determine a position of the doors 19 (i.e., open and closed). The door sensor 62 is in electrical communication with the controller 34 to deliver a signal indicative of the position of the doors 19.

The controller 34 is in electrical communication with the first and second control valves to control the flow of cryogen from the storage tank 20 to the evaporator coil 42. The controller 34 is also in communication with the first and second fans 50, 52, and the third valve 58. The controller 34 operates the first and second fans 50, 52 to draw air from the air-conditioned space 14 through the heat exchanger 37. The controller 34 varies the third valve 58 between open and closed positions to regulate the flow of coolant from the cooling cycle to the heating coil 54.

The controller or microprocessor 34 preferably uses ladder logic to control the flow of cryogen out of the storage tank 20. The controller 34 is powered by an engine 36 of the vehicle 16 (FIG. 1), or by an alternator (not shown) positioned within the engine 36. In alternative embodiments, the controller 34 can also or alternatively be powered by a battery, a fuel cell, a generator, or the like. In other embodiments, a stationary power source (not shown), for example an outlet located on a building, can supply power to the controller 34.

To begin operation of the control apparatus 10, the operator or a system administrator is prompted to enter one or more operating parameters or conditions into the controller 34, including the set point temperature SP. The operating conditions can also include an ambient temperature surrounding the air-conditioned space 14, a desired humidity for the air-conditioned space 14, a type of product positioned in the cargo compartment of the air-conditioned space 14, a desired temperature range, use of door curtains, duration of door openings, a time interval between door openings, a thermal mass of the product remaining in the truck, and the addition of warm cargo to the truck. In other embodiments, additional operating conditions can be entered into the controller.

During startup, the operator can direct the controller 34 to operate the control apparatus 10 in either a Fresh Range State or in a Frozen Range State by selecting the set point temperature SP. The control apparatus 10 further includes a Heat Range State (FIG. 7), a Defrost State (FIG. 8), and a Boil Stale (FIG. 9). Each of the Fresh Range State and the Frozen Range State can varied such that they are operable in one of the Heat Range State, the Defrost State, and the Boil State, depending on the operating conditions of the control apparatus 10 and the air-conditioned space 14.

The state of operation of the control apparatus 10 is based on the set point temperature SP that is entered by the operator into the controller 34. If the operator enters a set point temperature SP that is equal to or below 15 degrees Fahrenheit, the unit will operate in the Frozen Range State. Conversely, if the operator enters a set point temperature SP that is greater than 15 degrees Fahrenheit, the control apparatus 10 will operate in the Fresh Range State.

Once the set point temperature SP and the other operating parameters are entered, the first and second fans 50, 52 may be cycled on for a predetermined time period (e.g., 30 seconds) to circulate air in the air-conditioned space 14. The controller 34 then begins operation in either the Fresh Range State or the Frozen Range State.

Figure 3:
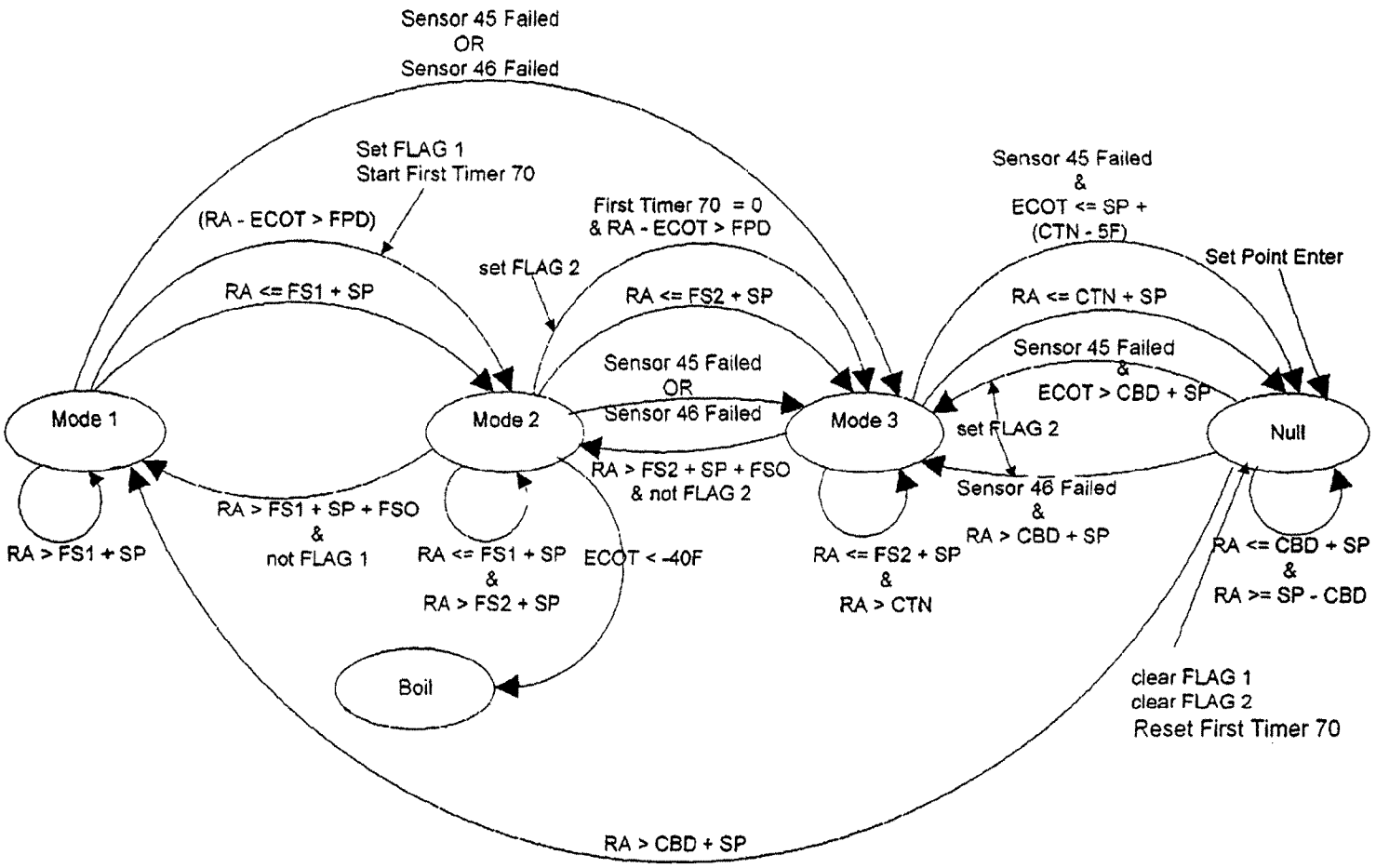
FIG. 3 is a diagram detailing a method of operating the cryogenic temperature control apparatus in a fresh range state.
Figure 4:
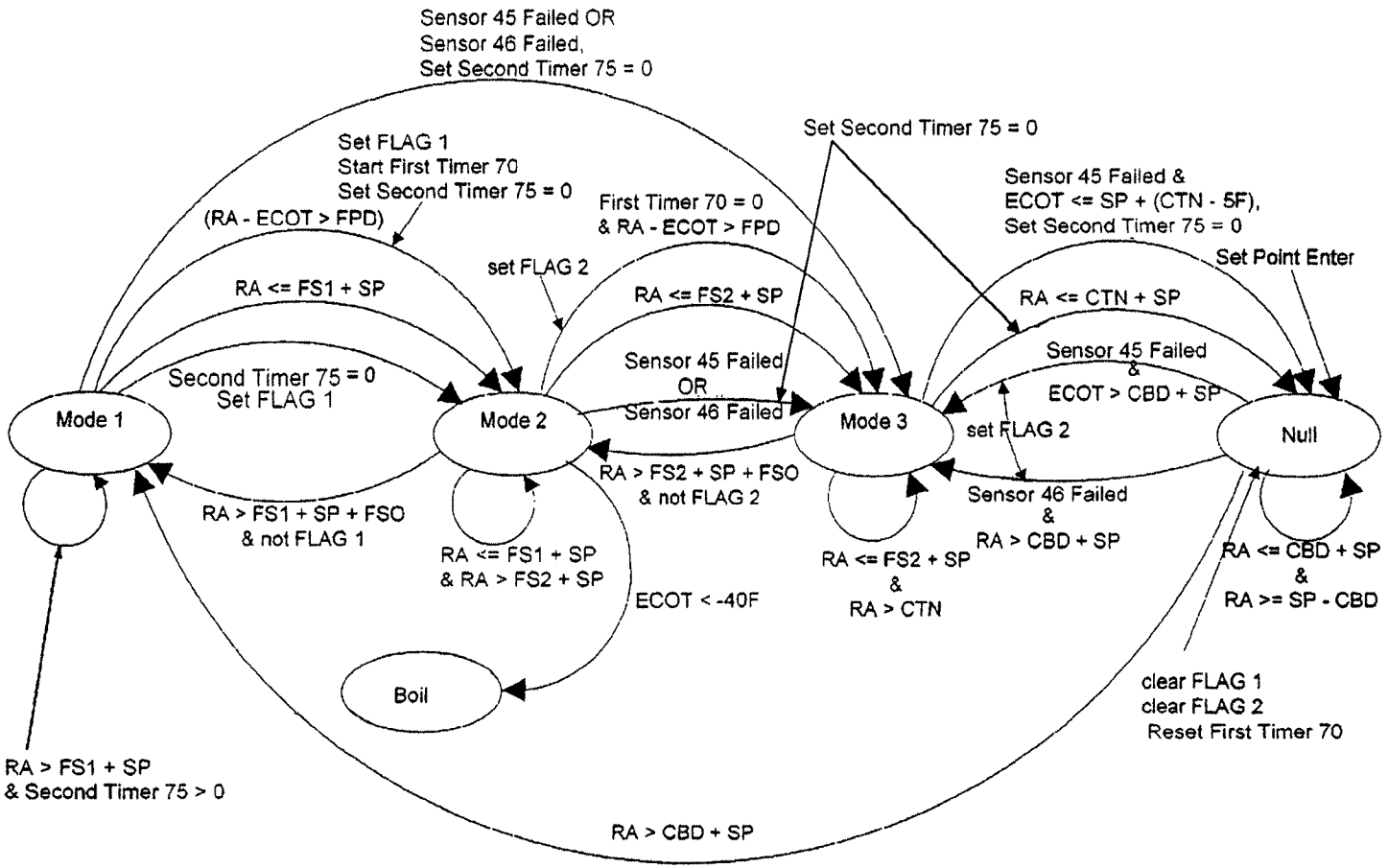
FIG. 4 is a diagram detailing another method of operating the cryogenic temperature control apparatus in a fresh range state.

Referring to FIGS. 3 and 4, the Fresh Range State includes a Mode 1, a Mode 2, a Mode 3, and a Null Mode. If the Fresh Range State is selected, the controller 34 directs the control apparatus 10 to begin operation in one of these modes based upon the return air temperature RA and the operator-supplied set point temperature SP. More particularly, the controller 34 calculates a temperature error (RA–SP) to determine an initial mode of operation (i.e., one of Mode 1, Mode, 2, Mode 3, Null Mode) of the control apparatus 10.

Each mode of operation (i.e., Mode 1, Mode 2, Mode 3) are cooling modes in the Fresh Range State and the Frozen Range State. The control apparatus 10 has a delay (e.g., 4 seconds) when transitioning from the Null Mode to one of the cooling modes. However, the first and second control valves 26, 32 remain off for a predetermined time period (e.g., first thirty seconds of cooling) when transitioning from the Null Mode to one of the cooling modes, if both fans were off in the Null Mole. The control apparatus 10 also has a delay (e.g., four seconds) when transitioning from the Null Mode to the Heat Range State. The delay when transitioning from the Null Mode to one of the cooling modes or the heating mode insures that a spike in temperature does not force the control apparatus 10 into an inappropriate operating mode. In different applications, the delays programmed into the controller 34 can be any length of time.

The control apparatus 10 further includes a delay (e.g., 10 seconds) when transitioning from the Heat Mode to the Null Mode, and a delay (e.g., 20 seconds) when transitioning from one of the cooling modes to the Null Mode. The delays when transitioning from the Heat Mode or the cooling modes to the Null Mode insure that the temperature of the air-conditioned space 14 is well within the null range and will stay there for a period of time before restarting the control apparatus.

Figure 8:
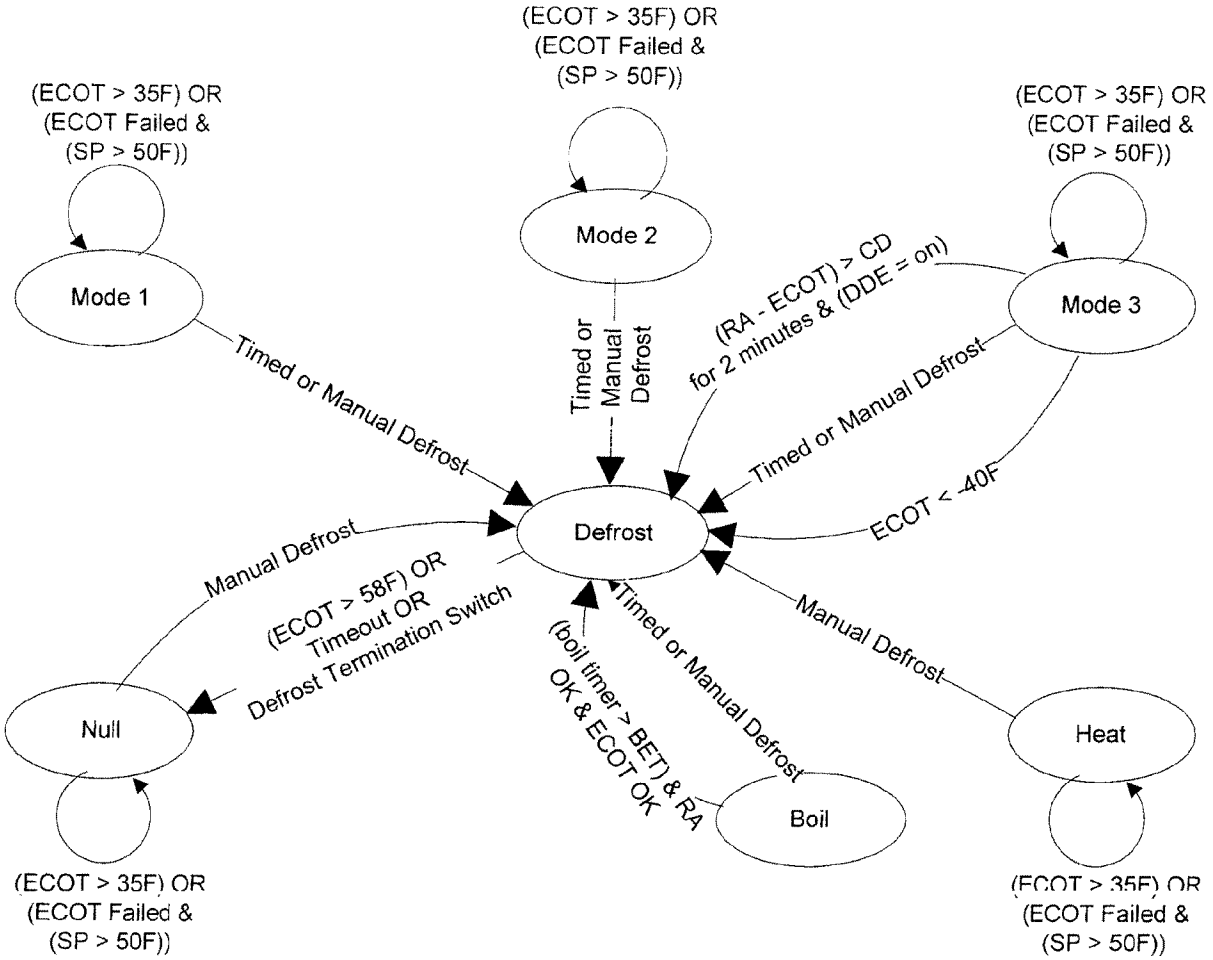
FIG. 8 is a diagram detailing a method of operating the cryogenic temperature control apparatus in a defrost state.
Figure 9:
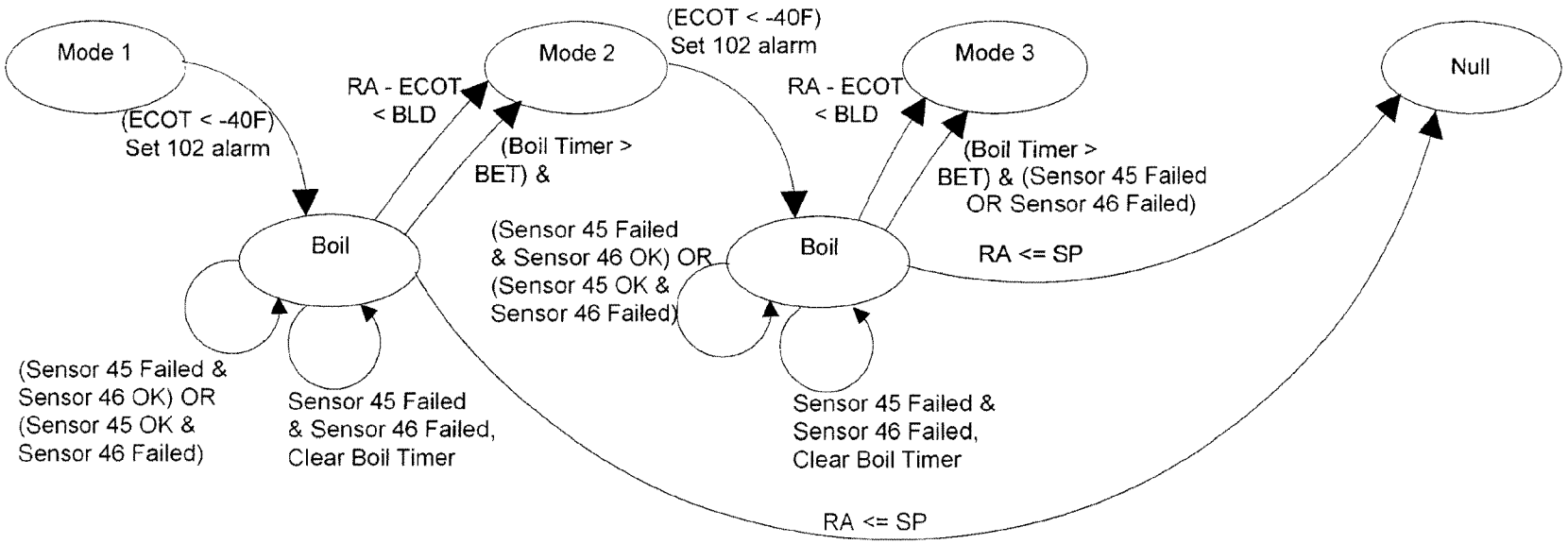
FIG. 9 is a diagram detailing a method of operating the cryogenic temperature control apparatus in a boil state.

As shown in FIG. 8, when the control apparatus 10 is shifted between the Null Mode and the Defrost State, there is no delay. Similarly, there is no delay when the any of the three cooling modes are shifted to the Defrost State. There is also no delay when the control apparatus 10 is shifted to the Boil State from the Null Mode, and when the control apparatus is shifted from the Boil State to any of the three cooling modes (FIG. 9).

The Fresh Range State also includes a control mode or algorithm that provides the operator with the ability to control the control apparatus 10 for optimal fuel savings (i.e., cryogen). FIG. 3 shows operation of the control apparatus 10 operated by the controller 34 in the Fresh Range State when the Control mode is not enabled. If the return air temperature RA exceeds the sum of the set point temperature SP and a first switch point temperature ("FS1") (e.g. 10 degrees Fahrenheit), the controller 34 is programmed to operate the control apparatus 10 in Mode 1.

Mode 1 is a first, high capacity cooling mode for the Fresh Range State. In Mode 1, the first and second control valves 26, 32 are opened to allow a maximum flow rate of cryogen through the evaporator coil 42, thereby providing a rapid temperature pull down of the air-conditioned space 14. The first and second fans 50, 52 are turned on and the damper 40 is opened to provide airflow across the evaporator coil 42. Additionally, the third valve 58 is closed to ensure that no coolant enters the heating element 53. When the return air temperature RA is higher than or equal to the sum of the first switch point temperature FS1 and the set point temperature SP, the controller 34 continues to operate the control apparatus 10 in Mode 1.

The controller 34 can switch operation of the control apparatus 10 from Mode 1 to Mode 2 based on a plurality of temperature control values. For example, if the return air temperature RA is less than or equal to the sum of the first switch point temperature FS1 and the set point temperature SP at startup, the controller 34 is programmed to begin operation of the control apparatus 10 in Mode 2. Similarly, if after operation in Mode 1, the return air temperature RA drops below or becomes equal to the sum of the first switch point temperature FS1 and the set point temperature SP, the controller 34 shifts the control apparatus 10 into Mode 2.

The controller 34 is also programmed to shift the control apparatus 10 into Mode 2 from Mode 1 if the outlet sensor 46 determines that liquid cryogen is about to exit the evaporator coil 42 and enter the outlet 43. In some cases, particularly when the mass flow rate of cryogen through the evaporator coil 42 is relatively high, some or all of the cryogen may not be completely vaporized in the evaporator coil 42. In these cases, the control apparatus 10 is not operating in the most efficient manner. Additionally, if flooding is left unchecked, some or all of the cryogen may solidify in the evaporator coil 42, rendering the control apparatus 10 inoperable. Therefore if the difference between the return air temperature RA and the evaporator coil outlet temperature ECOT is greater than a flood point differential ("FPD") (e.g., 30 degrees Fahrenheit), the controller 34 is programmed to shift from Mode 1 to Mode 2. The controller 34 also initializes a first control variable Flag 1 when the control apparatus 10 is shifted into Mode 2 in response to the difference between the return air temperature RA and the evaporator coil outlet temperature ECOT being greater than a flood point differential FPD. As discussed below, the first control variable Flag 1 inhibits shifting the control apparatus 10 from Mode 2 back to Mode 1 under certain operating conditions.

The controller 34 also initiates a first timer 70 when the control apparatus 10 is shifted into Mode 2 in response to the difference between the return air temperature RA and the evaporator coil outlet temperature ECOT being greater than a flood point differential FPD. The first timer 70 includes a predetermined time interval (e.g., 90 seconds) that provides a delay in the controller 34. The delay allows the control apparatus 10 to fully adjust to or enter Mode 2 after shifting from Mode 1, without the controller 34 shifting the control apparatus 10 to a different Mode prior to expiration of the first timer 70.

In Mode 2, the first valve 26 is opened and the second valve 32 is closed to provide a second flow rate of cryogen through the evaporator coil 42, thereby providing a relatively rapid temperature pull down and simultaneously conserving cryogen. The second flow rate is less than the first flow rate allowed by operation of the control apparatus 10 in Mode 1, thereby resulting in a lower capacity cooling mode as compared to Mode 1. The first and second fans 50, 52 are tuned on and the damper 40 is opened to provide airflow across the evaporator coil 42. Additionally, the third valve 58 is closed to ensure that no coolant enters the heating element 53.

The controller 34 may shift the control apparatus 10 from Mode 2 back to Mode 1 if the return air temperature RA rises above the sum of the set point temperature SP, the first switch point temperature FS1, and a fresh switch offset ("FSO") (e.g., 2 degrees Fahrenheit), of the control apparatus 10. However, the shift from Mode 2 to Mode 1 under these parameters occurs only if the first control variable Flag 1 has not been initiated by the controller 34. If the first control variable Flag 1 has been initiated, the controller 34 does not allow the control apparatus 10 to shift back to Mode 1, even when the return air temperature RA is higher than the sum of the set point temperature SP, the first switch point temperature FS1, and the fresh switch offset FSO. On the other hand, if the return air temperature RA drops below or becomes equal to the sum of the set point temperature SP and a second switch point temperature ("FS2") (e.g., 3 degrees Fahrenheit), the control apparatus 10 shifts into Mode 3.

In some applications flooding can occur during operation in Mode 2. Therefore, the controller 34 is preferably programmed to shift the control apparatus 10 into Mode 3 if the difference between the return air temperature RA and the evaporator coil outlet temperature ECOT is greater than the flood point differential FPD and the first timer 70 has decremented zero (i.e. the delay initiated by the first timer 70 has expired). The controller 34 also initializes a second control variable Flag 2 when the control apparatus 10 is shifted into Mode 3 in response to the difference between the return air temperature RA and the evaporator coil outlet temperature ECOT being greater than the flood point differential FPD, and the first timer 70 equal to zero. As discussed below, the second control variable Flag 2 inhibits shifting the control apparatus 10 from Mode 3 back to Mode 2 under certain operating conditions. The control apparatus 10 can also begin operation in Mode 3 at startup if the return air temperature RA is less than or equal to the sum of first switch point temperature FS2 and the set point temperature SP and if the return air temperature RA is greater than the sum of the set point temperature SP and the second switch point temperature FS2.

In Mode 3, the first control valve 26 is closed and the second control valve 32 is opened to provide a third, lower mass flow rate of cryogen through the evaporator coil 42. The third mass flow rate of cryogen in Mode 3 is a lower mass flow rate than the first and second mass flow rates defined by Modes 1 and 2, thereby providing a relatively slower temperature pull down and simultaneously conserving cryogen. The first and second fans 50, 52 are turned on and the damper 40 is opened to improve airflow through the heat exchanger 37 and the third valve 48 is closed to prevent heating.

The control apparatus 10 operates in Mode 3 as long as the return air temperature RA is less than or equal to the sum of the second switch point temperature FS2 and the set point temperature SP at startup, and when the return air temperature RA is higher than a cool-to-null temperature ("CTN") (e.g., 0.9 degrees Fahrenheit). If the return air temperature RA drops below the sum of the set point temperature SP and the cool-to-null temperature CTN, the control apparatus 10 switches to operation in the Null Mode.

The controller 34 may shift the control apparatus 10 from Mode 3 back to Mode 2 if the return air temperature RA rises above the sum of the set point temperature SP, the second switch point temperature FS2, and the fresh switch offset FSO. However, the shift from Mode 3 to Mode 2 under these parameters occurs only if the second control variable Flag 2 has not been initiated by the controller 34. If the second control variable Flag 2 has been initiated, the controller 34 does not allow the control apparatus 10 to shift back to Mode 2, even when the return air temperature RA is higher than the sum of the set point temperature SP, the second switch point temperature FS2, and the fresh switch offset FSO. On the other hand, if the return air temperature RA rises above the sum of the set point temperature SP, the second switch point temperature FS2, and the fresh switch offset FSO, and the second control variable Flag 2 has not been set, the control apparatus 10 shifts from Mode 3 to Mode 2.

In the Null Mode, the first and second control valves 26, 32 are closed to prevent cryogen from flowing through the evaporator coil 42 and the third valve 48 is closed to prevent coolant from entering the heating element 53. Additionally, the first and second fans 50, 52 are turned off to conserve power and to prevent the fans 50, 52 from heating the air-conditioned space 14. However, in some applications, the first and second fans 50, 52 can remain on during the Null Mode to maintain airflow in the air-conditioned space 14.

When the control apparatus 10 is switched from Mode 3 to the Null Mode, the first and second control valves 26, 32 are closed, as explained above. However, some residual cryogen still remains in the evaporator coil 42 after the first and second control valves 26, 32 are closed. This residual cryogen provides additional cooling to the air-conditioned space 14 to pull down the temperature of the air-conditioned space 14 after the flow of cryogen has been stopped. Additionally, the cooling capacity of the residual cryogen in the evaporator coil 42 is approximately equal to the cool-to-null temperature CTN. Therefore, when the control apparatus 10 is shifted from Mode 3 to the Null Mode, the residual cryogen pulls the temperature of the air-conditioned space 14 down to the set point temperature SP.

The control apparatus 10 can also begin operation in the Null Mode if the return air temperature RA is within a control band differential ("CBD") (e.g., 4 degrees Fahrenheit) surrounding the set point temperature SP. Generally, the control band differential CBD is determined to be the preferred operating temperature range for a particular cargo and is therefore preferably operator adjustable, but may also or alternatively be entered by the system administrator. If the return air temperature RA rises above the sum of the control band differential CBD and the set point temperature SP, the controller 34 is programmed to shift the control apparatus 10 from operation in the Null Mode to operation in Mode 1.

If either or both of the first control variable Flag 1 and the second control variable Flag 2 have been previously set, the controller 34 resets or clears the previously set first control variable Flag 1 and second control variable Flag 2 when the control apparatus 10 operates in the Null Mode. The controller 34 also resets the first timer 70 to the predetermined time when the control apparatus 10 is in the Null Mode.

The controller 34 is also programmed to accommodate failure of the sensors. More particularly, if the controller 34 determines that either the return air temperature sensor 45 or the evaporator coil outlet temperature sensor 46 has failed during operation in Mode 1 or Mode 2, the controller 34 is programmed to shift the control apparatus 10 into Mode 3. The control apparatus 10 also operates in Mode 3 until the return air temperature sensor 45 fails, and the evaporator coil outlet temperature ECOT drops below the sum of the set point temperature SP, the cool-to-null temperature CTN, and −5 degrees Fahrenheit, at which time the control apparatus 10 shifts to the Null Mode. If the return air temperature sensor 45 fails and the evaporator coil outlet temperature ECOT rises above the sum of the set point temperature SP and the control band differential CBD, the controller 34 shifts from the Null Mode to operation in Mode 3. The second control variable Flag 2 is set when the control apparatus 10 shifts back to Mode 3 from the Null Mode If the evaporator coil outlet temperature sensor 46 fails during operation in the Null Mode, the control apparatus 10 continues to operate in the Null Mode until the return air temperature RA rises above the sum of the control band differential CBD and the set point temperature SP, at which time the controller 34 shifts to operation in Mode 3. The second control variable Flag 2 is set when the control apparatus 10 shifts back to Mode 3 from the Null Mode.

FIG. 4 shows the control apparatus 10 in the Fresh Range State with the control mode enabled. The control mode is a fuel conservation mode that prescribes a predetermined time duration that the control apparatus 10 can operate in Mode 1, the highest capacity cooling mode. In other words, the predetermined time duration is a maximum time that the control apparatus 10 can be operated in Mode 1, determined by the operating conditions of the control apparatus 10. As described in detail below, the controller 34 uses a second timer 75 to limit the time duration that the control apparatus 10 is operated in Mode 1.

The control mode is enabled and active when the operator activates a fuel saver setting programmed into the controller 34. When the second timer 75 decrements to zero during operation of the apparatus 10 in Mode 1, the apparatus 10 is shifted to Mode 2 and cannot return back to Mode 1 until the second timer 75 has been reset to the predetermined time duration. The second timer 75 resets when a program input of the controller 34 equals 'Yes'. The second timer 75 is set to zero if the program input equals 'No' based on the following parameters: power cycle of the controller 34, on/off cycle of the controller 34 and/or the apparatus 10, shutdown alarm. In other embodiments, the second timer 75 can be set to zero based on other programmable aspects of the controller 34 (e.g., exiting an access menu, etc.).

The control mod not only allows the product to reach the set point temperature (SP), but also limits operation in Mode 1 even if the return air temperature RA goes above the control band differential CBD. The operating conditions input by the operator determine how large the difference between the return air temperature RA and the control band can be while still providing an acceptable temperature pull down of the product. In other words, the operator determines the parameters of the control mode, which control the predetermined time duration that the control apparatus 10 is operated in Mode 1.

The second timer 75 is defined by the combination of a Mode 1 timer setting and a Mode 1 door timer setting programmed into the controller 34. The controller 34 decrements the second timer 75 from the predetermined time duration to zero. When both the Mode 1 timer setting and the Mode 1 door timer setting are non-zero values, the maximum amount of time that the control apparatus 10 operates in Mode 2 is determined by the timer setting that has the larger time value. The second timer 75 reaches zero when both timer settings reach zero, and the apparatus 10 is shifted from Mode 1, as described in detail below.

Except as described below, operation of control apparatus 10 in the Fresh Range State with the control mode enabled is the same as the operation of the control apparatus 10 in the Fresh Range State without the control mode enabled (FIG. 3). The predetermined time duration programmed into the second timer 75 determines the amount of time that the control apparatus 10 can be operated in Mode 1. In other words, the control apparatus 10 is operable in Mode 1 when the return air temperature RA is higher than the first switch point temperature FS1 and the set point temperature SP, and when the second timer is not equal to zero.

When the second timer 75 is decremented to zero based on operation of the control apparatus 10 in Mode 1, the controller 34 shifts the control apparatus 10 into Mode 2. The control variable Flag 1 is set when the control apparatus 10 shifts from Mode 1 into Mode 2 based on the second timer 75 decrementing to zero. As described above with regard to FIG. 3, if the difference between the return air temperature RA and the evaporator coil outlet temperature ECOT is greater than the flood point differential FPD, the controller 34 is programmed to shift the control apparatus 10 from Mode 1 to Mode 2. As the apparatus 10 is shifted to Mode 2, the control variable Flag 1 is set, the first timer 70 is initiated, and the second timer 75 is set to zero.

As described above, the controller 34 may shift the control apparatus 10 from Mode 2 back to Mode 1 if the return air temperature RA rises above the sum of the set point temperature SP, the first switch point temperature FS1, and the fresh switch offset. However, the shift from Mode 2 to Mode 1 under these parameters can only occur when the first control variable Flag 1 has not been initiated by the controller 34. If the first control variable Flag 1 has been initiated, the controller 34 does not allow the control apparatus 10 to shift back to Mode 1.

If the controller 34 determines that either the return air temperature sensor 45 or the evaporator coil outlet temperature sensor 46 has failed during operation in Mode 1 or Mode 2, the controller 34 is programmed to shift the control apparatus 10 into Mode 3. When the Mode 3 is entered due to failure of one or both of the sensors 45, 46, the controller 34 sets the second timer 75 to zero. If the return air temperature RA drops below the sum of the set point temperature SP and the cool-to-null temperature CTN, the control apparatus 10 switches to operation in the Null Mode, and the controller 34 sets the second timer 75 to zero.

As described above, if the controller 34 determines that either the return air temperature sensor 45 or the evaporator coil outlet temperature sensor 46 has failed during operation in Mode 1 or Mode 2, the controller 34 is programmed to shift the control apparatus 10 into Mode 3. At approximately the same time that the control apparatus 10 is shifted from either of Mode 1 or Mode 2 to Mode 3, the controller 34 sets the second timer 75 to zero. Similarly, the control apparatus 10 operates in Mode 3 until the return air temperature sensor 45 fails, and the evaporator coil outlet temperature ECOT drops below the sum of the set point temperature SP, the cool-to-null temperature CTN, and −5 degrees Fahrenheit, at which time the control apparatus 10 shifts to the Null Mode. At approximately the same time that the control apparatus 10 is shifted from Mode 3 to the Null Mode, the controller 34 sets the second timer 75 to zero.

Figure 5:
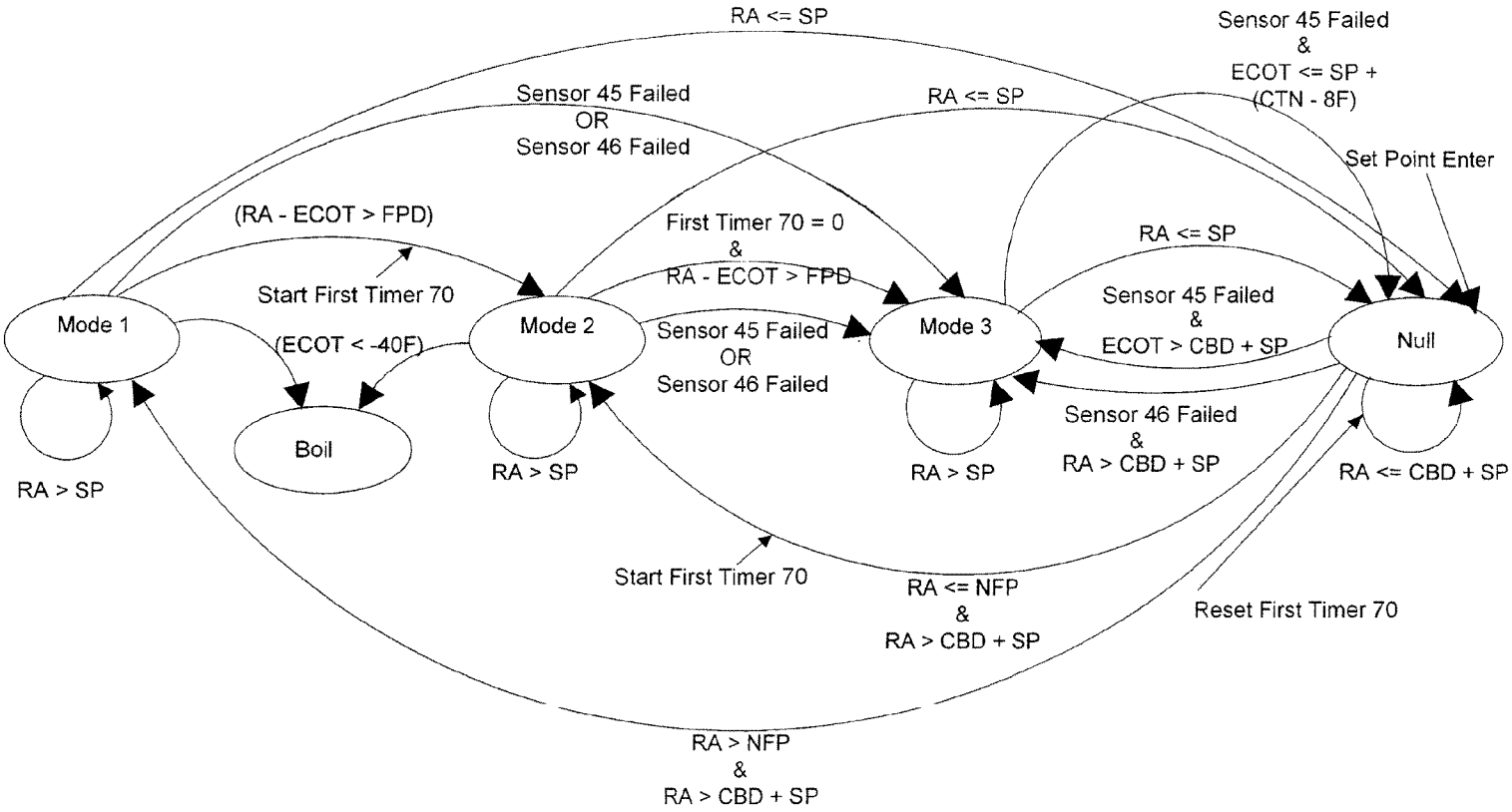
FIG. 5 is a diagram detailing a method of operating the cryogenic temperature control apparatus in a frozen range state.

If the set point temperature SP is less than or equal to 15° F., the unit will function in a frozen mode of operation. FIG. 5 shows the Frozen Range State of the control apparatus 10 with the control mode disabled by the controller 34. The Frozen Range State includes a Mode 1, a Mode 2, a Mode 3, and a Null Mode that are similar to the modes of operation in the Fresh Range State. In other words, Mode 1 is a first, high capacity cooling mode, Mode 2 is a cooling mode that has a relatively lower capacity than Mode 1, and Mode 3 is a cooling mode that has a relatively lower capacity than Mode 2. The modes of operation differ only in that the Frozen Range State is operated at colder temperatures than the temperatures of the modes of operation in the Fresh Range State. Similarly, the controller 34 calculates the temperature error (RA−SP) to determine the initial mode of operation (i.e., one of Mode 1, Mode, 2, Mode 3, Null Mode) of the control apparatus 10 in the Frozen Range State. When the cryogen temperature control apparatus 10 is operating in the Frozen Range State of operation the Heating Mode is locked out.

Except as described below, the Frozen Range State with the control mode disabled is similar to the Fresh Range State with the control mode disabled. If the return air temperature RA is greater than the set point temperature SP, the control apparatus 10 begins operating in Mode 1. Once, the return air temperature RA becomes equal to or drops below the set point temperature SP, the control apparatus 10 is shifted from Mode 1 to the Null Mode.

As explained above with respect to the Fresh Range State, some or all of the cryogen in the evaporator coil 42 may not evaporate during cooling operations and the evaporator coil 42 may begin to fill with liquid cryogen. If the flooding occurs, the cryogen may solidify in the evaporator coil 42 and may damage the control apparatus 10. Therefore, to prevent flooding, the control apparatus 10 shifts from Mode 1 into Mode 2 if the difference between the return air temperature RA and the evaporator coil outlet temperature ECOT drops below the flood point differential FPD (e.g., 30 degrees Fahrenheit), the control apparatus 10 shifts into Mode 2. The controller 34 also initiates the first timer 70 when the control apparatus 10 is shifted into Mode 2 in response to the difference between the return air temperature RA and the evaporator coil outlet temperature ECOT being greater than the flood point differential FPD. The controller 34 controls the control apparatus 10 in Mode 2 for the entire time duration of that the timer 70 has a non-zero value.

The control apparatus 10 continues to operate in Mode 2 as long at the return air temperature RA remains above the set point temperature SP. If the difference between the return air temperature RA and the evaporator coil outlet temperature ECOT drops below the flood point differential FPD, and the first timer 70 has decremented to zero, the control apparatus 10 shifts into Mode 3. Similarly, the control apparatus 10 shifts into Mode 3 if either the return air sensor 45 or the outlet sensor 46 fails. If the return air temperature RA becomes equal to or drops below the set point temperature SP, the control apparatus 10 is shifted from operation in Mode 2 to operation in the Null Mode.

In Mode 3, if the return air temperature RA drops below or becomes equal to the set point temperature SP, the control apparatus 10 shifts from Mode 3 to the Null Mode. Similarly, the control apparatus 10 shifts from Mode 3 to the Null Mode if the return air sensor 45 has failed and the evaporator coil outlet temperature ECOT drops below the sum of the set point temperature SP, the cool-to-null temperature CTN, and −8 degrees Fahrenheit.

The control apparatus 10 continues to operate in the Null Mode as long as cooling is required and the return air temperature RA is less than or equal to the sum of the set point temperature SP and a predetermined control band differential CBD (e.g., 4 degrees Fahrenheit). The first timer 70 is reset when the control apparatus is in the Null Mode. If the return air temperature RA rises above the sum of the control band differential CBD, and the set point temperature SP and if the return air temperature RA is greater than a null flood prevent temperature ("NFP") (e.g., 15 degrees Fahrenheit), the control apparatus 10 shifts to Mode 1. Conversely, if the return air temperature RA rises above the sum of the control band differential CBD and the set point temperature SP and the return air temperature RA is less than or equal to the null flood prevent temperature NFP, the control apparatus 10 shifts into Mode 2. When the control apparatus 10 is shifted into Mode 2, the controller 34 starts the first timer 70.

If the return air temperature sensor 45 fails and the evaporator coil outlet temperature ECOT rises above the sum of the set point temperature SP and the control band differential CBD, the controller 34 shifts from the Null Mode to operation in Mode 3. If the evaporator coil outlet temperature sensor 46 fails during operation in the Null Mode, the control apparatus 10 continues to operate in the Null Mode until the return air temperature RA rises above the sum of the control band differential CBD and the set point temperature SP, at which time the controller 34 shifts to operation in Mode 3.

Figure 6:
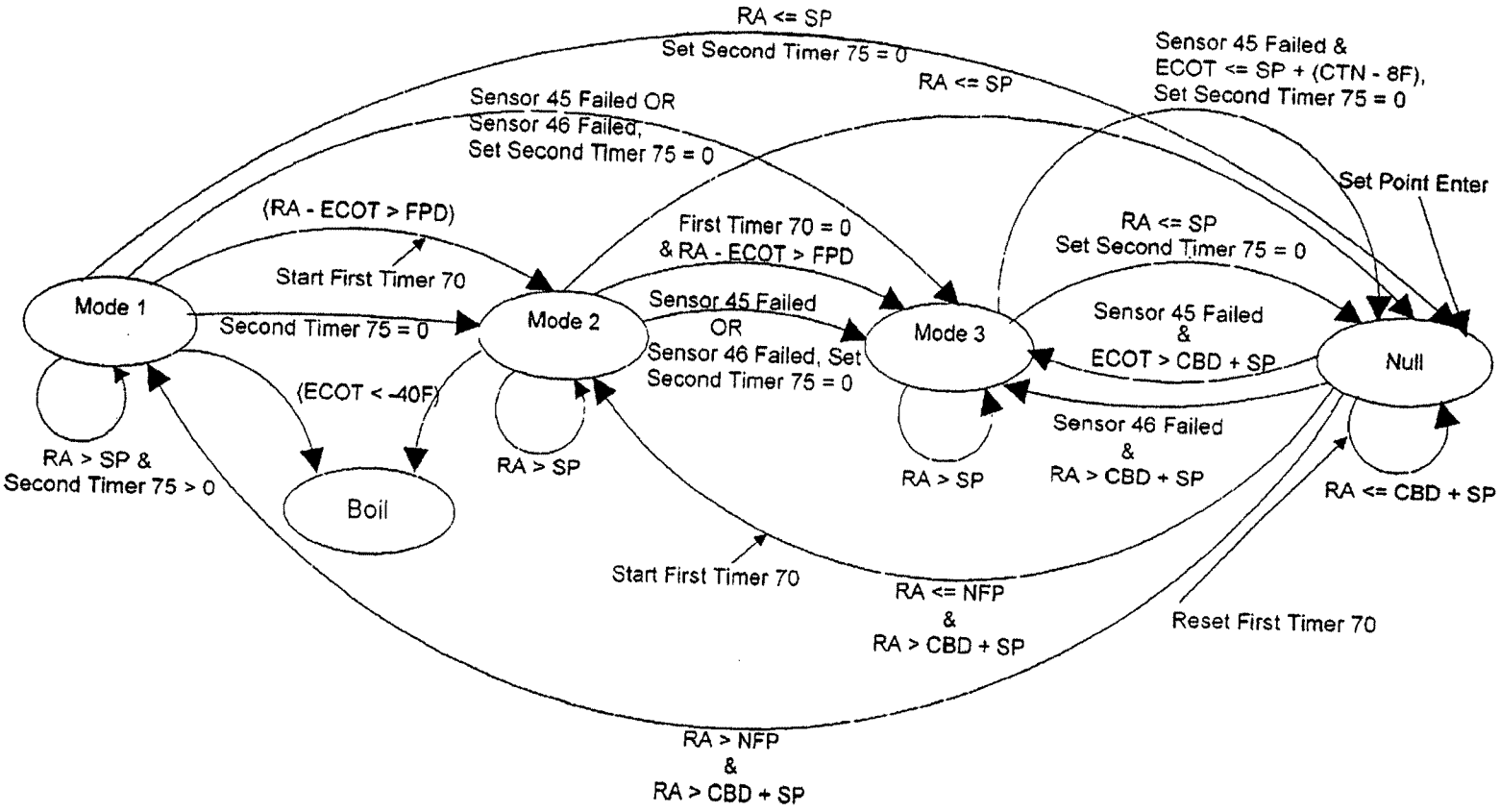
FIG. 6 is a diagram detailing another method of operating the cryogenic temperature control apparatus in a frozen range state.

FIG. 6 shows the Frozen Range State with the control mode enabled by the controller 34. Operation of the Frozen Range State with the control mode enabled is similar to the operation of the Frozen Range State with the control mode disabled. With the control mode enabled, the Frozen Range State includes the second timer 75 that limits the time duration that the control apparatus 10 operates in Mode 1, as described with regard to FIG. 4. The control mode for the Frozen Range State is similar to the control mode for the Fresh Range State. As such, the control mode for the Frozen Range State will not be discussed in detail.

If the doors 19 are opened during the Fresh or Frozen Range States, the control apparatus 10 enters a Door Mode and all of the outputs of the controller 34 are turned off. The control apparatus 10 will resume normal operation when either the doors 19 are closed, or after a time delay determined by the door timer setting that is in communication with the door switch 62. If the door timer setting is set to zero or if the control mode is enabled, the control apparatus 10 will remain in the Door Mode indefinitely. If the door timer setting is set for a predetermined time interval (e.g., 30 seconds), then the unit will remain in the Door Mode until the predetermined time interval has elapsed. Then, if the apparatus 10 was in one of the cooling modes (i.e., Modes 1, 2, or 3) or the Heating Mode prior to entering the Door Mode, the control apparatus 10 will restart. If the apparatus 10 was in the Null Mode prior to entering the Door Mode, it will return to operation in the Null Mode. If the control apparatus 10 resumed normal operation because of the elapsed predetermined time interval, the door switch 62 will be ignored until the power is cycled, the on/off switch is toggled, or the doors are closed and opened again.

During operation of the control apparatus 10 in either the Fresh Range State or the Frozen Range State, there can be repeated opening and closing of the doors 19. As a result, the product temperature can be outside of the desired temperature range. The control mode allows operation of the control apparatus 10 in Mode 1 for the predetermined time duration after the doors are opened and closed to cool the product. Whenever the control mode is enabled, the second timer 75 decrements from the predetermined time duration to zero during operation of the apparatus 10 in Mode 1.

Generally, when the control apparatus 10 is in either the Fresh Range State or the Frozen Range State, the second timer 75 decrements to zero according to the predetermined time duration during operation of the apparatus 10 in Mode 1 when the control mode is enabled. As long as the second timer 75 has not decremented to zero, the apparatus 10 continues to operate in Mode 1. When the second timer 75 reaches zero, the controller 34 shifts the apparatus 10 to Mode 2. In addition, the second timer 75 is set to zero in either the Fresh Range State or the Frozen Range State when the control mode is enabled, and in response to at least one of the following conditions: Null Mode entered from Mode 1, Mode 2, Mode 3 or the Heating Mode, and a sensor failure (e.g., return air sensor 45 and/or outlet sensor 46). The second timer 75 is also set to zero or disabled when the control mode is exited by the controller 34. When the apparatus 10 is in the Defrost State or when the doors 19 are open, the second timer 75 holds the predetermined time duration at the time value just prior to the apparatus 10 entering the Defrost State or just prior to the doors 19 being opened.

Figure 7:
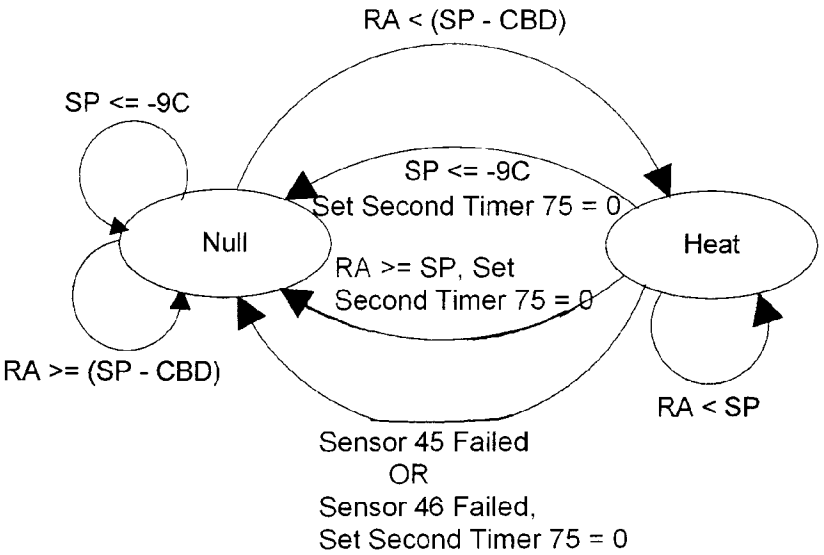
FIG. 7 is a diagram detailing a method of operating the cryogenic temperature control apparatus in a heat range stale.

In some applications, such as when the ambient temperature is below the set point temperature SP, it may be desirable to heat the air-conditioned space 14 by controlling the control apparatus 10 in the Heat Range State. As illustrated in FIG. 7, during operation in the Fresh Range State, the control apparatus 10 can operate in the Heat Range State if the return air temperature RA drops below the difference between the set point temperature SP and the control band differential CBD. Once the return air temperature RA reaches or exceeds the set point temperature SP, the control apparatus 10 shifts from the Heat Range State to the Null Mode. The control apparatus also can shift from the Heat Range State to the Null Mode when the setpoint temperature is less than or equal to a predetermined temperature (e.g., 15 degrees Fahrenheit), or when either the return air sensor 45 or the outlet sensor 46 have failed. In general, when the control apparatus 10 is shifted to the Null Mode from the Heat Range State, the second timer 75 is set to zero.

Occasionally, water vapor from the air-conditioned space 14 can be separated from the air and can condense on the evaporator coil 42, forming frost. To minimize the formation of frost on the evaporator coil 42 and to remove frost from the evaporator coil 42, the controller 34 is programmed to operate the control apparatus 10 in the Defrost State during operation in either the Fresh Range State or the Frozen Range State (FIG. 8).

When the cryogenic temperature control apparatus 10 operates in the Defrost State, the first and second control valves 26, 32 are closed so that cryogen does not enter the evaporator coil 42. The third control valve 58 is opened to allow coolant to enter the heating element 53 and the damper 40 is closed to prevent warm air from entering the air-conditioned space 14. Preferably, the first and second fans 50, 52 are deactivated.

The cryogenic temperature control apparatus 10 can shift into the Defrost State in four different ways. First, the operator can manually direct the controller 34 to shift the cryogenic temperature control apparatus 10 into the Defrost State. However, to prevent the operator from unnecessarily initiating the Defrost State, the controller 34 is programmed to prevent manual initiation unless either the evaporator coil outlet temperature ECOT is less than or equal to 35 degrees Fahrenheit or the set point temperature SP is less than or equal to 50 degrees Fahrenheit.

Second, the Defrost State can be initiated at predetermined time intervals (e.g., two hours) which are programmed by the system administrator. However, unless the evaporator coil outlet temperature ECOT is less than or equal to 35 degrees Fahrenheit or the set point temperature SP is less than or equal to 50 degrees Fahrenheit, the Defrost State will not be initiated at the predetermined time intervals.

Third, the Defrost State can be initiated based upon demand when the controller 34 determines that specific requirements have been met. Specifically, the Defrost State is initiated if the evaporator coil outlet temperature ECOT is less than or equal to 35 degrees Fahrenheit and the mass flow rate of cryogen moving through the cryogenic temperature control apparatus 10 is above a predetermined mass flow rate (e.g., during operation in Mode 3 when the first control valve is closed and the second control valve 32 is open). Alternatively, the Defrost State is initiated when the return air temperature RA minus the evaporator coil outlet temperature ECOT is above a predetermined amount (e.g., 8 degrees Fahrenheit), which is preferably adjustable and may be programmed by the system administrator. The predetermined mass flow rate is a function of the operating environment, including expected ambient humidity levels and evaporator sizes and therefore is preferably determined by the system administrator or may be entered by the operator during startup.

Fourth, the Defrost State is automatically initiated when the evaporator coil outlet temperature ECOT is less than −40 degrees Fahrenheit and the mass flow rate of cryogen moving through the cryogenic temperature control apparatus 10 is above the predetermined mass flow rate.

Once the Defrost State is initiated, defrosting continues until the air temperature around the defrost termination switch 48 is equal to the defrost termination temperature DTS (e.g., 45 degrees Fahrenheit) or the evaporator coil outlet temperature ECOT reaches 59 degrees Fahrenheit. Additionally, in some applications, the controller 34 is programmed to terminate the Defrost State after a predetermined time.

The controller 34 is also programmed to operate the control apparatus 10 in the Boil State during operation in either the Fresh Range State or the Frozen Range State (FIG. 9). As shown in FIGS. 5 and 6, if the evaporator outlet coil temperature ECOT drops below −40 degrees Fahrenheit, the controller 34 is programmed to shift the control apparatus 10 from Mode 1 or Mode 2 into the Boil State. As shown in FIGS. 3 and 4, if the evaporator outlet coil temperature ECOT drops below −40 degrees Fahrenheit, the controller 34 is programmed to shift the control apparatus 10 from Mode 2 into the Boil State.

Various features and advantages of the invention are set forth in the following claims.

What is claimed is:

1. A method of temperature control in a cryogenic temperature control apparatus, the method comprising: operating the cryogenic temperature control apparatus in a first mode; delivering a first flow rate of cryogen from a storage tank to an evaporator coil in the first mode; inhibiting operation of the cryogenic temperature control apparatus in the first mode after operating the cryogenic temperature control apparatus in the first mode for a predetermined time duration; operating the cryogenic temperature control apparatus in a second mode after operating the cryogenic temperature control apparatus in the first mode for the predetermined time duration; and delivering a second flow rate of cryogen that is lower than the first flow rate to the evaporator coil in the second mode; further including setting a timer of a controller to the predetermined time duration based on a plurality of operating conditions of the cryogenic temperature control apparatus.

2. The method of claim 1, further comprising:

setting the predetermined time duration to a maximum non-zero time duration;

decrementing the predetermined time duration from the maximum time duration to zero while operating the cryogenic temperature control apparatus in the first mode; and varying a first control variable from a first setting for operation in the first mode to a second setting for operation in the second mode in response to the predetermined time duration being decremented to zero.

3. The method of claim 1, further comprising:

sensing a temperature at an air inlet of the evaporator coil;

sending a signal indicative of the temperature at the air inlet to a controller; and continuing to operate the cryogenic temperature control apparatus in the second mode when the sensed inlet temperature exceeds a predetermined temperature.

4. The method of claim 1, further comprising:

sensing a temperature at an air inlet of the evaporator coil with a first sensor;

sensing a temperature at an outlet of the evaporator coil with a second sensor;

operating the cryogenic temperature control apparatus in a third mode after operating the cryogenic temperature control apparatus in the second mode when a controller determines a failure in at least one of the first and second sensors; and delivering a third flow rate of cryogen lower than the second flow rate to the evaporator coil in the third mode.

5. The method of claim 1, further comprising:

sensing a temperature at an air inlet of the evaporator coil with a first sensor;

sending a signal indicative of the air inlet temperature from the first sensor to the controller;

sensing a temperature at the outlet of the evaporator coil with a second sensor;

sending a signal indicative of the outlet temperature from the second sensor to the controller;

comparing at least one of the sensed air inlet temperature and the sensed outlet temperature to at least one of a plurality of temperature control values;

operating the cryogenic temperature control apparatus in a second mode after operating the cryogenic temperature control apparatus in the first mode when at least one of the sensed air inlet temperature and the sensed outlet temperature is above a temperature control value for the cryogenic temperature control apparatus; and setting a timer for operation of the cryogenic temperature control apparatus in the first mode from a non-zero value to zero.

6. The method of claim 1, further comprising decrementing the predetermined time duration in response to operation of the cryogenic temperature control apparatus in the first mode.

7. The method of claim 6, wherein decrementing the predetermined time duration includes suspending the decrementing predetermined time duration;

shifting operation of the cryogenic temperature control apparatus from the first mode to either of a defrost state and a door mode for a period of time;

shifting operation of the cryogenic temperature control apparatus from either of the defrost state and the door mode to the first mode after the period of time has elapsed; and continuing decrementing the predetermined time duration in response to operation of the cryogenic temperature control apparatus in the first mode.

8. A cryogenic temperature control apparatus comprising:

an evaporator coil in thermal communication with an air-conditioned space, the evaporator coil including an air inlet and an outlet;

a storage tank in fluid communication with the evaporator coil;

a valve assembly positioned between the storage tank and the evaporator coil, the valve assembly adjustable between a first position configured to deliver a first mass flow rate of cryogen and a second position configured to deliver a second mass flow rate of cryogen; and a controller in electrical communication with the valve assembly, the controller programmed to selectively operate the valve assembly between the first and second positions, the first position defining a first mode of operation for the cryogenic temperature control apparatus and the second position defining a second mode of operation for the cryogenic temperature control apparatus, the controller programmed to limit the time duration that the cryogenic temperature control apparatus is operated in the first mode to a predetermined time duration.

9. The apparatus of claim 8, wherein the second mass flow rate is less than the first mass flow rate.

10. The apparatus of claim 8, wherein the time duration that the cryogenic temperature control apparatus is operated in the first mode is limited in response to a control mode enabled by the controller.

11. The apparatus of claim 10, wherein the air-conditioned space is accessible through a door, and wherein the time duration that the cryogenic temperature control apparatus is operated in the first mode is suspended by the controller in response to the door moved to an open position.

12. The apparatus of claim 8, wherein the controller is programmed to select the predetermined time duration that the cryogenic temperature control apparatus is operated in the first mode based on a plurality of operating conditions.

13. The apparatus of claim 12, wherein the plurality of operating conditions includes at least one of an ambient temperature, humidity, a desired operating temperature range, a door open time duration, and a product type.

14. The apparatus of claim 8, wherein the cryogenic temperature control apparatus is operable in the second mode in response to expiration of the predetermined time duration.

15. The apparatus of claim 14, wherein the controller is programmed to decrement the predetermined time duration from a maximum time value to zero in response to operation of the cryogenic temperature control apparatus in the first mode.

16. The apparatus of claim 8, further comprising a first sensor in communication with the air inlet of the evaporator coil to sense an air inlet temperature at the air inlet, and a second sensor in communication with the evaporator coil outlet to sense an outlet temperature of the evaporator coil at the outlet, wherein each of the first sensor and the second sensor are in electrical communication with the controller to deliver respective signals indicative of the air inlet temperature and the outlet temperature to the controller.

17. The apparatus of claim 16, wherein the cryogenic temperature control apparatus is operable in the second mode in response to at least one of the sensed air inlet temperature and the sensed outlet temperature above a temperature control value for the cryogenic temperature control apparatus.

18. The method of claim 1, allowing operation of the cryogenic temperature control apparatus in the first mode again upon resetting of the predetermined time duration.

19. The apparatus of claim 8, wherein the controller is programmed to inhibit operation of the cryogenic temperature control apparatus in the first mode after operating the cryogenic temperature control apparatus in the first mode for the predetermined time duration.

20. The apparatus of claim 19, wherein the controller is programmed to allow operation of the cryogenic temperature control apparatus in the first mode again upon resetting of the predetermined time duration.

* * * * *